US009775437B2

(12) United States Patent
Stark, III et al.

(10) Patent No.: US 9,775,437 B2
(45) Date of Patent: Oct. 3, 2017

(54) ANCHOR SYSTEM FOR EXTRUDED COLUMNS

(71) Applicants: James M Stark, III, Tallahassee, FL (US); Patrick E Hoy, Tallahassee, FL (US)

(72) Inventors: James M Stark, III, Tallahassee, FL (US); Patrick E Hoy, Tallahassee, FL (US)

( * ) Notice: Subject to any disclaimer, the term of this patent is extended or adjusted under 35 U.S.C. 154(b) by 246 days.

(21) Appl. No.: 13/895,853

(22) Filed: May 16, 2013

(65) Prior Publication Data

US 2014/0339384 A1 Nov. 20, 2014

Related U.S. Application Data

(60) Provisional application No. 61/648,917, filed on May 18, 2012.

(51) Int. Cl.
*A47B 96/06* (2006.01)
*E04B 2/74* (2006.01)

(52) U.S. Cl.
CPC ..... *A47B 96/061* (2013.01); *E04B 2/7455* (2013.01); *E04B 2002/7483* (2013.01)

(58) Field of Classification Search
CPC ..... A47B 57/42; A47B 57/46; A47B 96/061; A47B 96/06; A47B 96/07; A47B 57/52; A47B 57/56; E04B 1/2608; E04B 2/7455; E04B 2002/7483
USPC ..... 248/219.4, 247, 295.11, 248, 903, 200, 248/300, 250; 211/119.004, 119.009, 211/90.01–90.04, 89.01, 193, 186, 187; 52/36.4, 36.5, 73, 235, 698, 713; 403/234, 205, 403
See application file for complete search history.

(56) References Cited

U.S. PATENT DOCUMENTS 625,427 A * 5/1899 Stewart, Jr. ..... F16B 7/0446 182/87
933,067 A * 9/1909 Ferry ..... F16B 12/46 182/228.3
1,729,586 A * 9/1929 Liebman ..... E06B 3/9687 126/190
2,365,501 A * 12/1944 Walstrom ..... E04B 1/2604 403/174
3,567,014 A * 3/1971 Feigelman ..... B65D 77/0426 206/767
3,858,682 A * 1/1975 Larson ..... B25H 1/06 182/153
D289,605 S * 5/1987 Lytle ..... D8/381
4,665,672 A * 5/1987 Commins ..... E04B 1/0007 403/190
5,096,272 A * 3/1992 Belokin et al. ..... 312/129
(Continued)

*Primary Examiner* — Stanton L Krycinski
*Assistant Examiner* — Guang H Guan
(74) *Attorney, Agent, or Firm* — J. Wiley Horton

(57) ABSTRACT

An anchoring system for extruded columns which is useful in supporting structures in a way that does not require drilling or screwing into the column structure. The anchoring system is comprised of brackets which are mounted against extruded columns by inserting a bracket blade into place between a gasket and a structural medium. The anchoring brackets are preferably composed of two pieces which link together for increased support. The anchoring system can support a variety of mountings which can be either physically attached to the anchoring brackets or rest atop the anchoring brackets.

14 Claims, 12 Drawing Sheets

(56) References Cited

U.S. PATENT DOCUMENTS

| | | | | | |
|---|---|---|---|---|---|
| 5,111,632 | A * | 5/1992 | Turner | 52/702 | |
| 5,403,110 | A * | 4/1995 | Sammann | E04B 1/5831 | 403/205 |
| 5,564,248 | A * | 10/1996 | Callies | 52/702 | |
| D383,374 | S * | 9/1997 | Sammann | D8/354 | |
| 6,349,911 | B1 * | 2/2002 | Feldpausch et al. | 248/243 | |
| 6,454,106 | B1 * | 9/2002 | Howard | A47B 45/00 | 211/43 |
| 7,398,621 | B2 * | 7/2008 | Banta | E04B 1/2608 | 403/235 |
| 8,136,677 | B2 * | 3/2012 | Brozak et al. | 211/50 | |
| 8,720,155 | B1 * | 5/2014 | Robell | 52/702 | |
| 9,376,797 | B2 * | 6/2016 | Yang | E04B 1/24 | |
| 2014/0339384 | A1 * | 11/2014 | Stark, III | E04B 2/7455 | 248/219.4 |

* cited by examiner

ANCHOR SYSTEM FOR EXTRUDED COLUMNS

CROSS-REFERENCES TO RELATED APPLICATIONS

This application is a non-provisional patent application claiming priority to U.S. Provisional Application No. 61/648,917 filed on May 18, 2012. The applications name the same inventors.

STATEMENT REGARDING FEDERALLY SPONSORED RESEARCH OR DEVELOPMENT

Not Applicable.

MICROFICHE APPENDIX

Not Applicable

BACKGROUND OF THE INVENTION

1. Field of the Invention

This invention relates to the fields of architecture and building construction. More specifically, the invention is comprised of a bracket system which is mounted against extruded columns.

2. Description of the Related Art

Large glass windows, walls and doors are common in both industrial and residential buildings. Open concept floor plans and advances in glass safety, efficiency and overall manufacturing technology have led to an increase in the installation of glass walls and windows by residential homeowners and commercial business alike.

Although glass walls and windows are desirable, one problem they present is of lack of shelving, storage space and structures for load support. It is simple and straightforward to build a temporary or permanent shelf or structural element attached to a wall consisting of primarily drywall with wooden studs. However, it is difficult to install a sturdy shelving unit or other structural element affixed to glass or similar material. As illustrated in FIG. 1, glass wall construction 10 typically consist of extruded columns 12 (preferably aluminum) connected together by an inner wall 18, a structural medium 14 (preferably glass) and a series of gaskets 16. The structural medium 14 sits between extruded columns 12 and is held tightly in place by gaskets 16 on either side. The design and construction of the wall may vary. For example, structural medium 14 may be double paned and include a spacer 20 as illustrated.

Prior art shelving units or anchoring systems for glass wall construction 10 were primarily designed to drill directly into the extruded columns 12. One such prior art unit is illustrated in FIG. 2. As shown, extruded columns 12 extend toward the interior of the building include drilled holes 22 which accept shelving unit 24. The holes 22 in the extruded columns 12 are often difficult to drill and are more permanent than a hole drilled into drywall. Thus, in the event that the shelf is no longer desired, the holes in the extruded columns 12 (typically metal) are permanently visible. Further, commercial businesses may desire temporary shelving which does not compromise the integrity of the extruded columns 12 and are easy to install. There is not presently an anchor system which achieves these objectives.

Therefore what is needed is an anchor system which allows a bracket to be easily and non-permanently installed on the constructed wall as described. Additionally, the brackets should be sturdy and strong to support a shelving unit or other structural element. The present invention achieves these objectives and more as described herein.

BRIEF SUMMARY OF THE INVENTION

The present invention comprises an anchoring system of brackets which utilize thin blades, preferably made from metal but potentially made from a plurality of materials, which are locked into place between a gasket attached to an extruded column and a structural medium, such as a plate glass window. The anchoring system preferably allows for some an additional plurality of structures to be attached, connected, or alternatively placed on top of or below said system. In a preferred embodiment, the anchoring brackets are composed of two pieces which can be linked together after the blade of each side is inserted between the gasket and the structural medium. The anchoring system is preferably split into two sections which can then be linked together. The linking connection can be achieved through a plurality of mechanisms, preferably a male female type overlapping connection between the two sections. This allows for a more secure fit and for the anchoring system to hold more weight.

REFERENCE NUMERALS IN THE DRAWINGS

Figure 1:
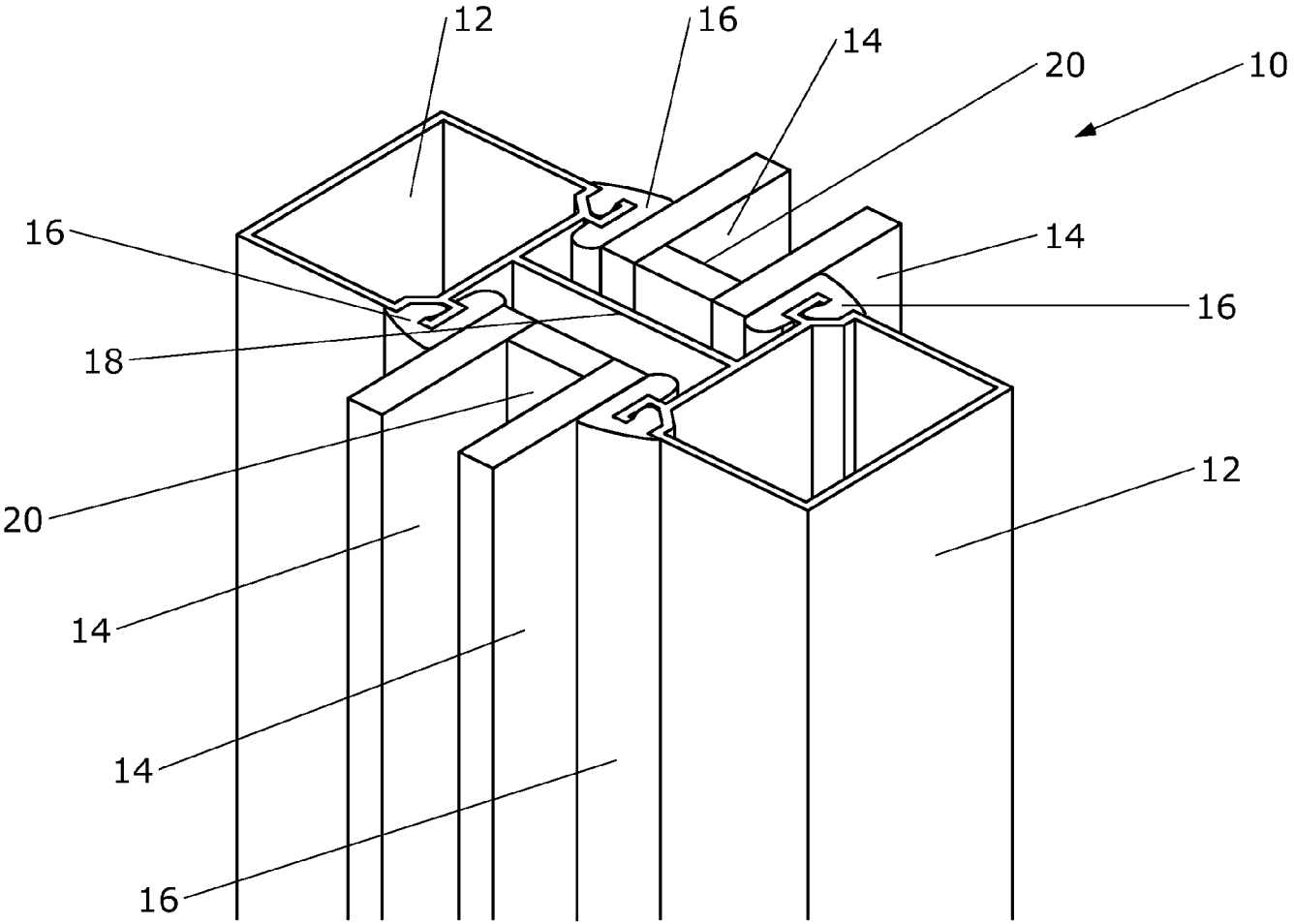
FIG. 1 (PRIOR ART)
FIG. 1 is a perspective view, showing the components of a prior art construction of a glass wall.
Figure 2:
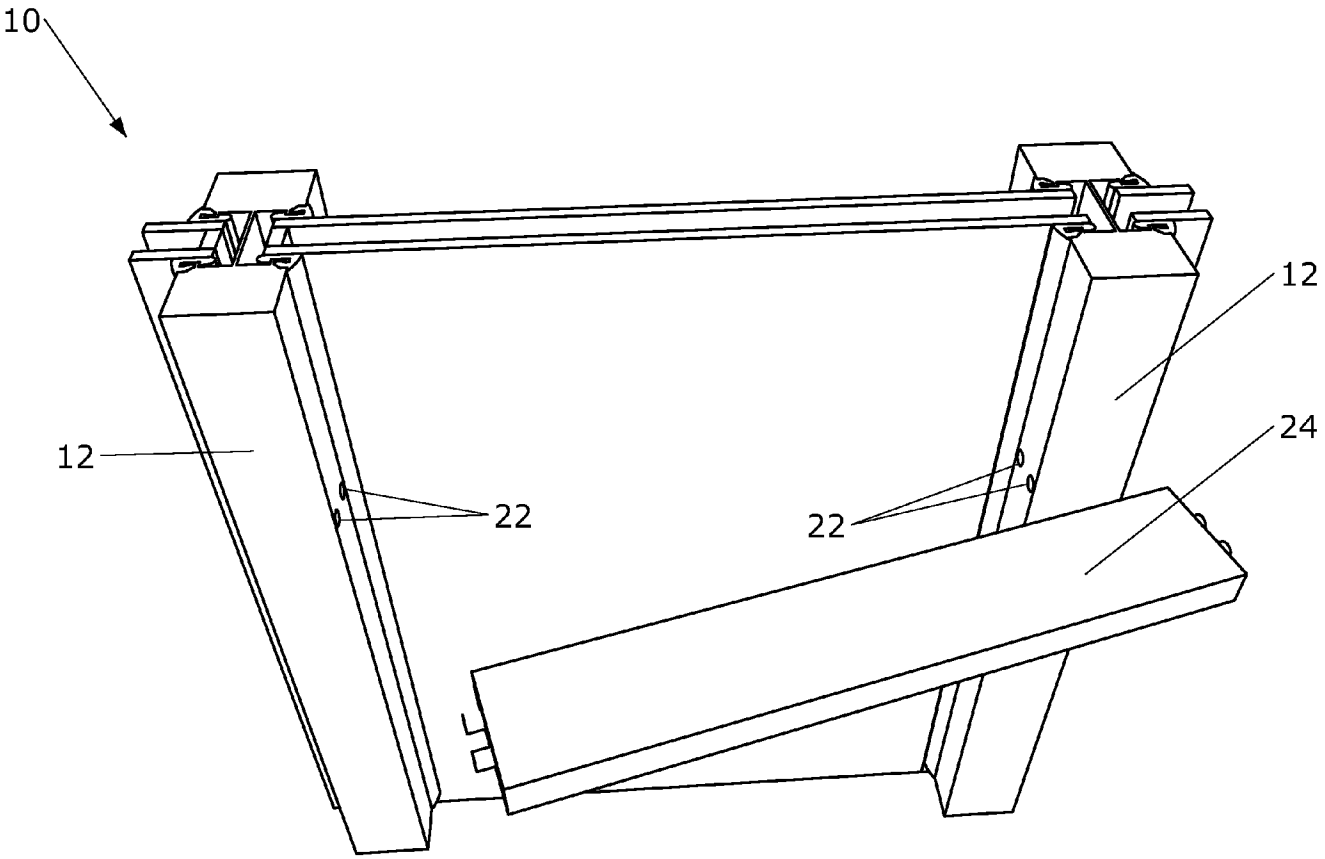
FIG. 2 (PRIOR ART)
FIG. 2 is a perspective view, showing the installation of a prior art structural element on a prior art glass wall.

| | |
|---|---|
| 10 wall construction | 12 extruded column |
| 14 structural medium | 16 gaskets |
| 18 inner wall | 20 spacer |
| 22 holes | 24 shelving unit |
| 26 bracket blade | 27 bracket blade |
| 28 bracket side flap | 29 bracket side flap |
| 30 anchoring bracket | 32 first bracket |
| 34 second bracket | 36 bracket top flange |
| 37 bracket top flange | 38 bracket side flange |
| 39 bracket side flange | 40 bracket back flange |
| 41 bracket back flange | 42 linking mechanism |
| 44 bracket section | 45 bracket section |
| 46 bracket blade bend | 48 external structure |

-continued

| REFERENCE NUMERALS IN THE DRAWINGS | |
|---|---|
| 50 bracket system | 52 void |
| 54 void | |

DETAILED DESCRIPTION OF THE INVENTION

As described above, FIG. 1 illustrates a prior art wall construction 10. Wall construction 10 is constructed in order to provide support for large glass or similar material structural mediums 14. Extruded columns 12 are connected by an inner wall 18 which support structural medium 14 between extruded columns 12 and gaskets 16. Glass or structural medium 14 can be double paned with a spacer 20 between the panes for or single paned. The assembly of wall construction 10 is important to the functioning of the present bracket system 50.

Figure 3:
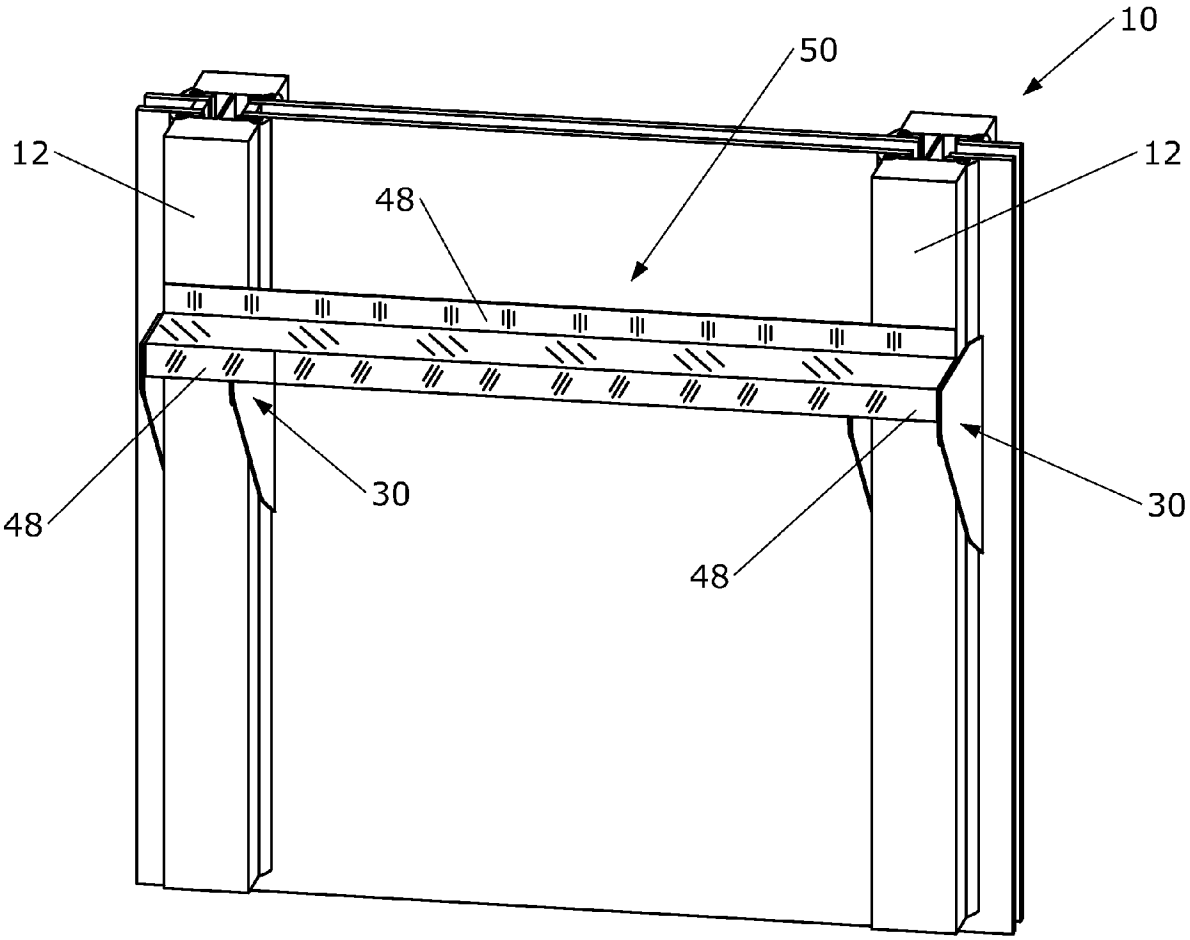
FIG. 3 is a perspective view, showing the present bracket system installed on a wall construction.

FIG. 3 provides a perspective view of bracket system 50 attached to a glass wall construction 10. At least two anchoring brackets 30 are illustrated which attach around extruded columns 12. Anchoring brackets 30 are formed by first and second bracket 32, 34 described and illustrated herein. External structure 48 such as a shelf sits on top of and can optionally connect to anchoring brackets 30. Anchoring system 50 provides considerable support and does not require drilling or screwing into the extruded columns 12.

Figure 4:
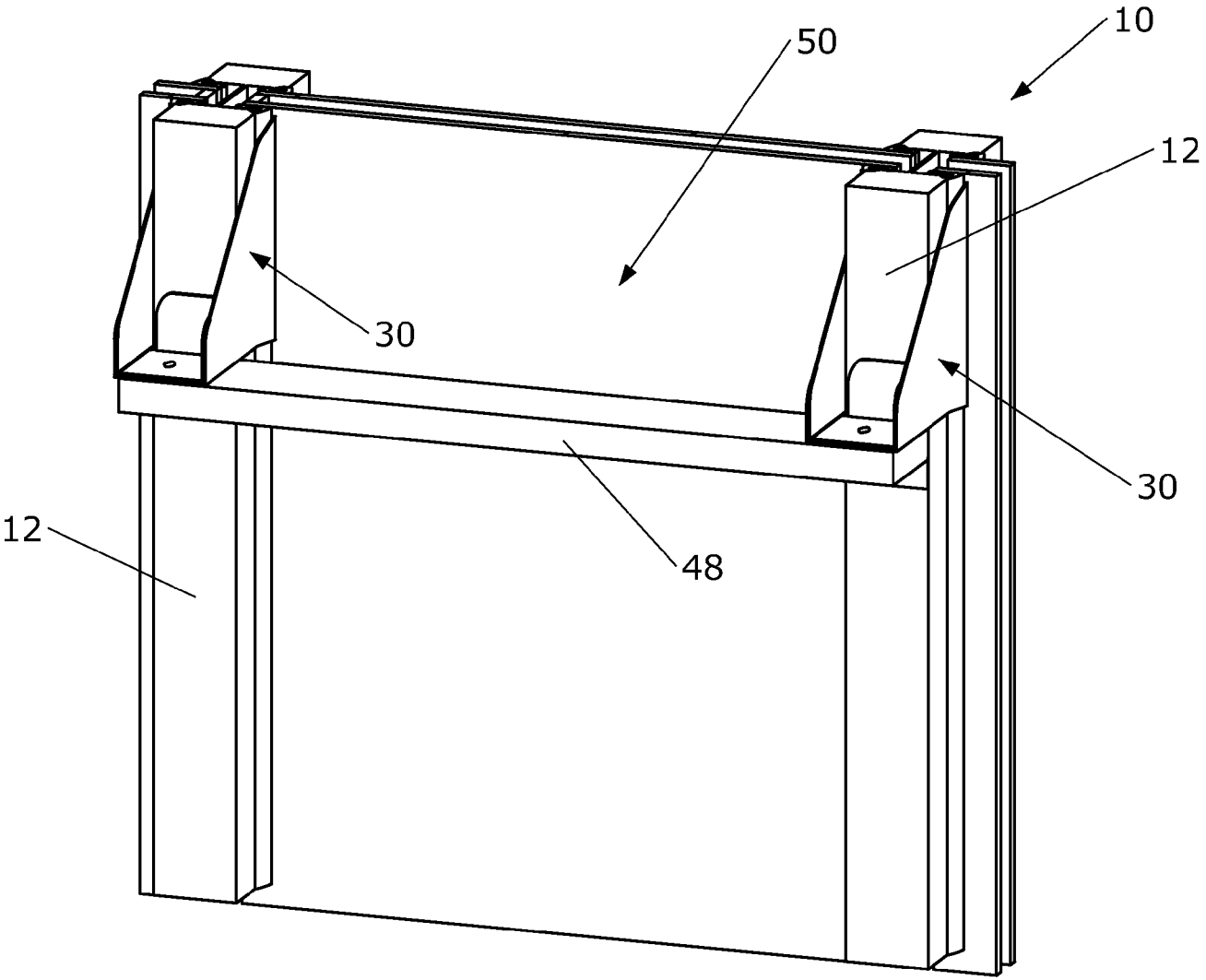
FIG. 4 is a perspective view, showing the present bracket system inverted and installed on a wall construction.

Bracket system 50 can also support an external structure 48 attached to at least two anchoring brackets 30, as shown in FIG. 4. Anchoring brackets 30 are inverted but installed in the same manner. An external structure 48 can be affixed by any means to the anchoring brackets 30 to support a load. As an example, a window treatment, such as blinds, can be affixed to anchoring brackets 30 and hung from the window. Thus, the blinds are not drilled into the existing window structure and are easier to install.

Figure 5:
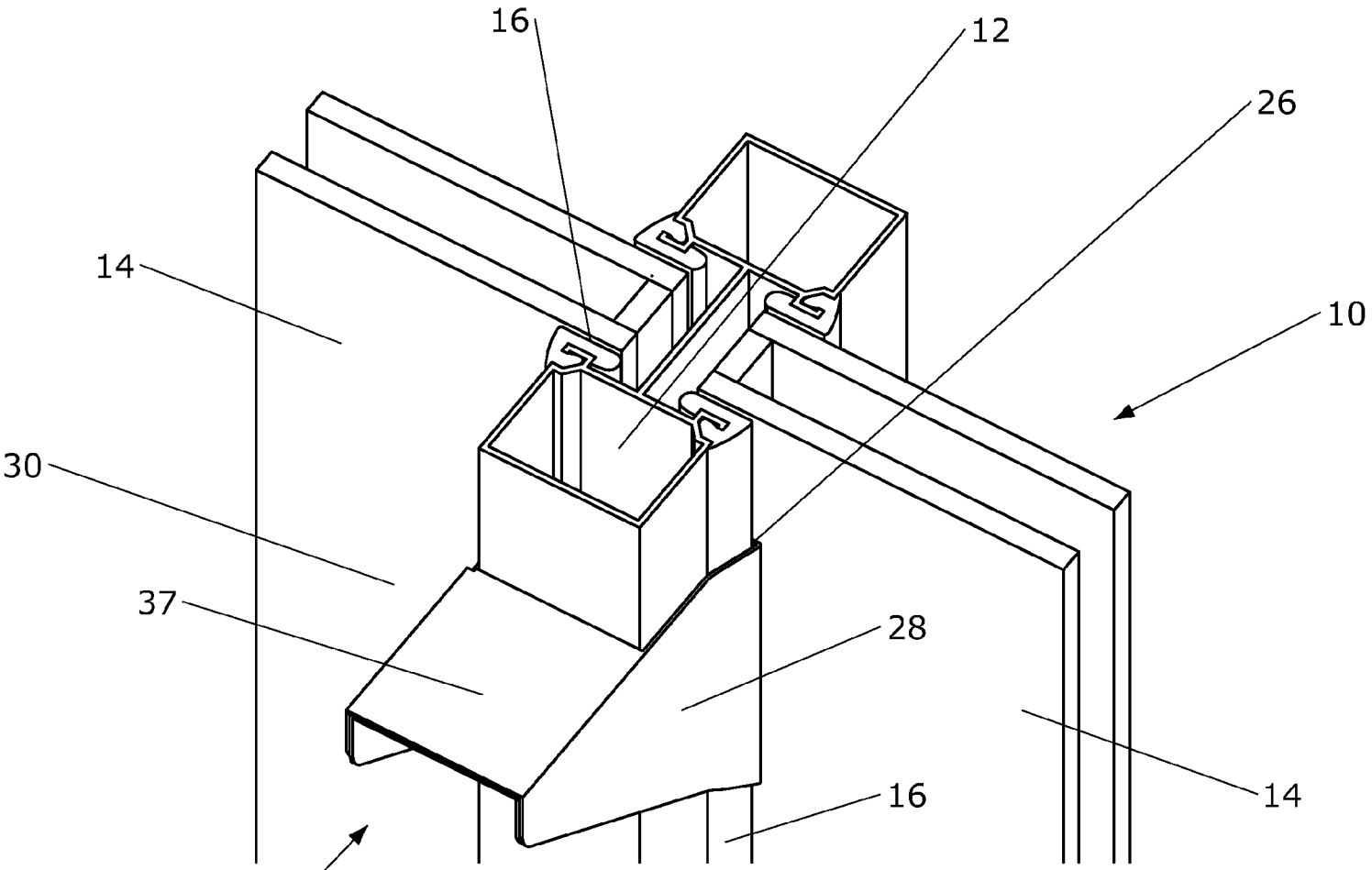
FIG. 5 is a perspective view, showing the brackets of the present bracket system installed on an extruded column.

A view of anchoring bracket 30, composed of first bracket 32 and second bracket 34 (not visible in FIG. 5) assembled together attached around extruded column 12 is illustrated in FIG. 5. First bracket blade 26 (and second bracket blade 40, not visible) slide behind extruded column 12 and are frictionally engaged between structural medium 14 and gaskets 16. The pressure of gasket 16 against bracket blade 26, 40 holds the anchoring bracket 30 in place against the force of gravity. While anchoring bracket 30 is shown in a configuration in which top flange 37 (or 36) is providing an upward facing support, anchoring bracket 30 can also be configured such that top flange 37 (or 36) provides a downward facing support. In such a configuration, anchoring bracket 30 can support a hanging load.

Figure 6:
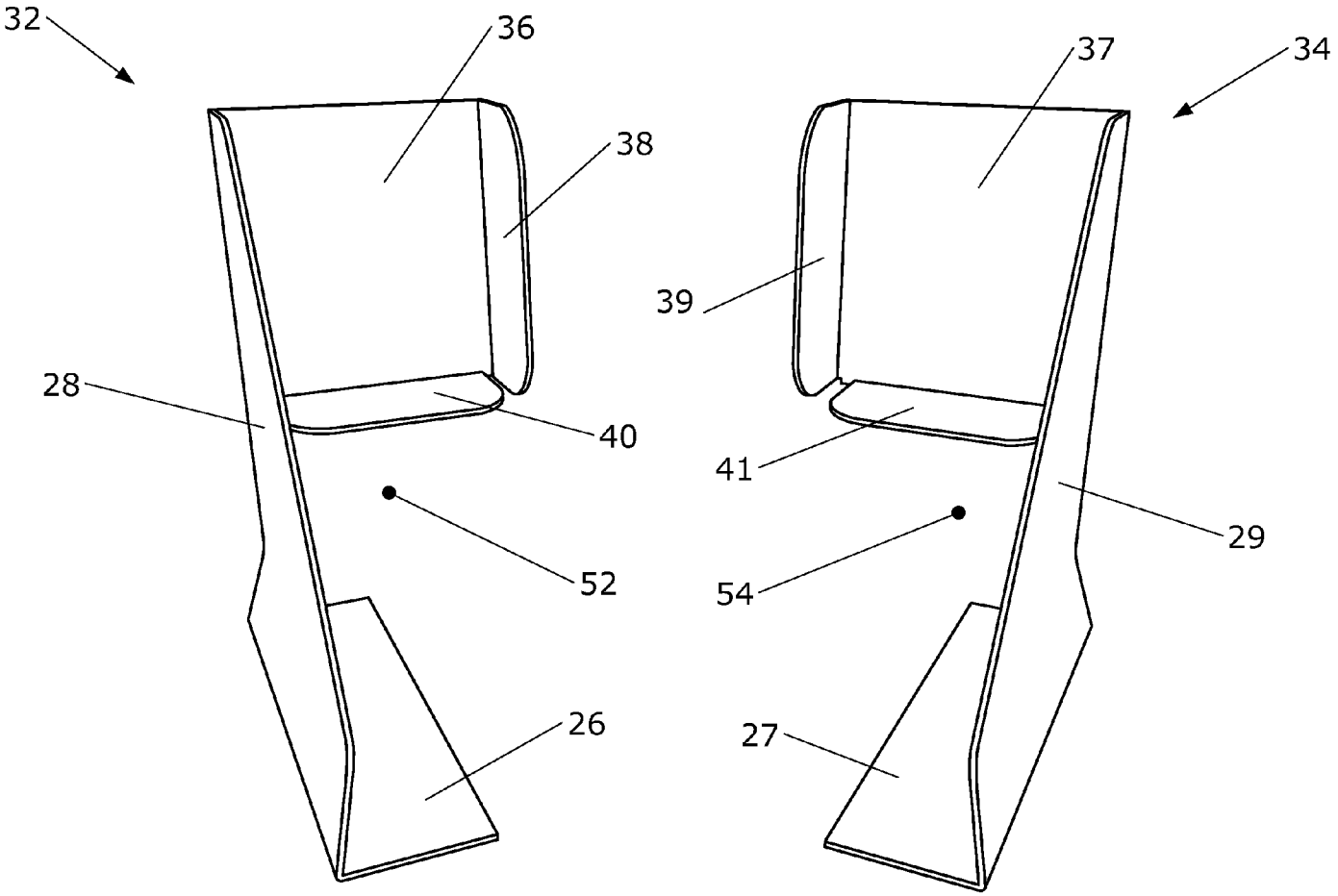
FIG. 6 is a perspective view, showing the brackets of the present bracket system.

FIG. 6 provides a perspective view of first bracket 32 and second bracket 34 which make up anchoring bracket 30. As illustrated, first bracket 32 and second bracket 34 are made up of a bracket blade 26, 27, bracket side flap 28, 29, bracket top flange 36, 37, bracket side flange 38, 39 and bracket back flange 40, 41. A central void 52, 54 is formed by the structural elements of first and second bracket 32, 34. When installed, illustrated in FIG. 5, extruded column 12 fills void 52.

Figure 7:
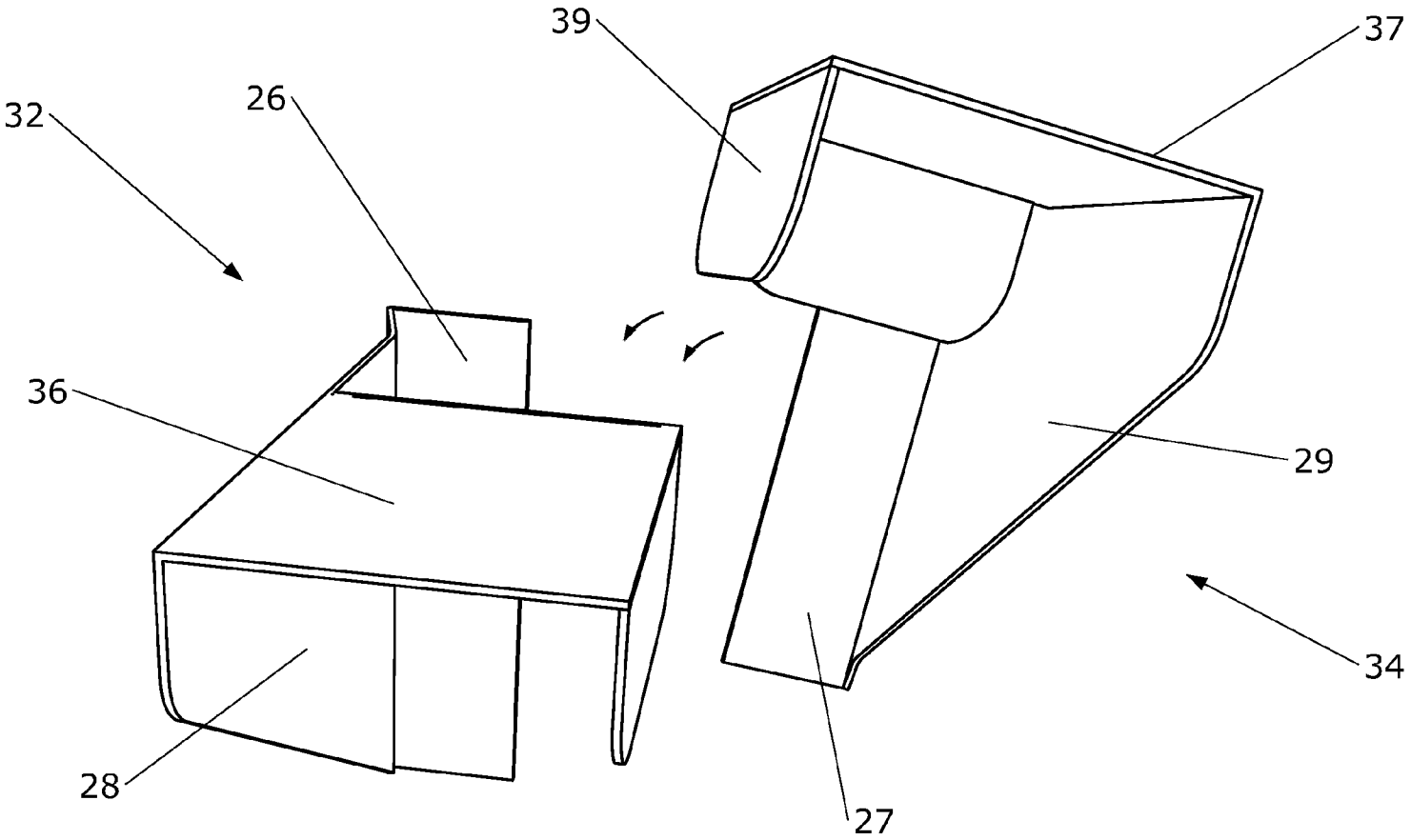
FIG. 7 is a perspective view, showing the brackets of the present bracket system fitting together.
Figure 8:
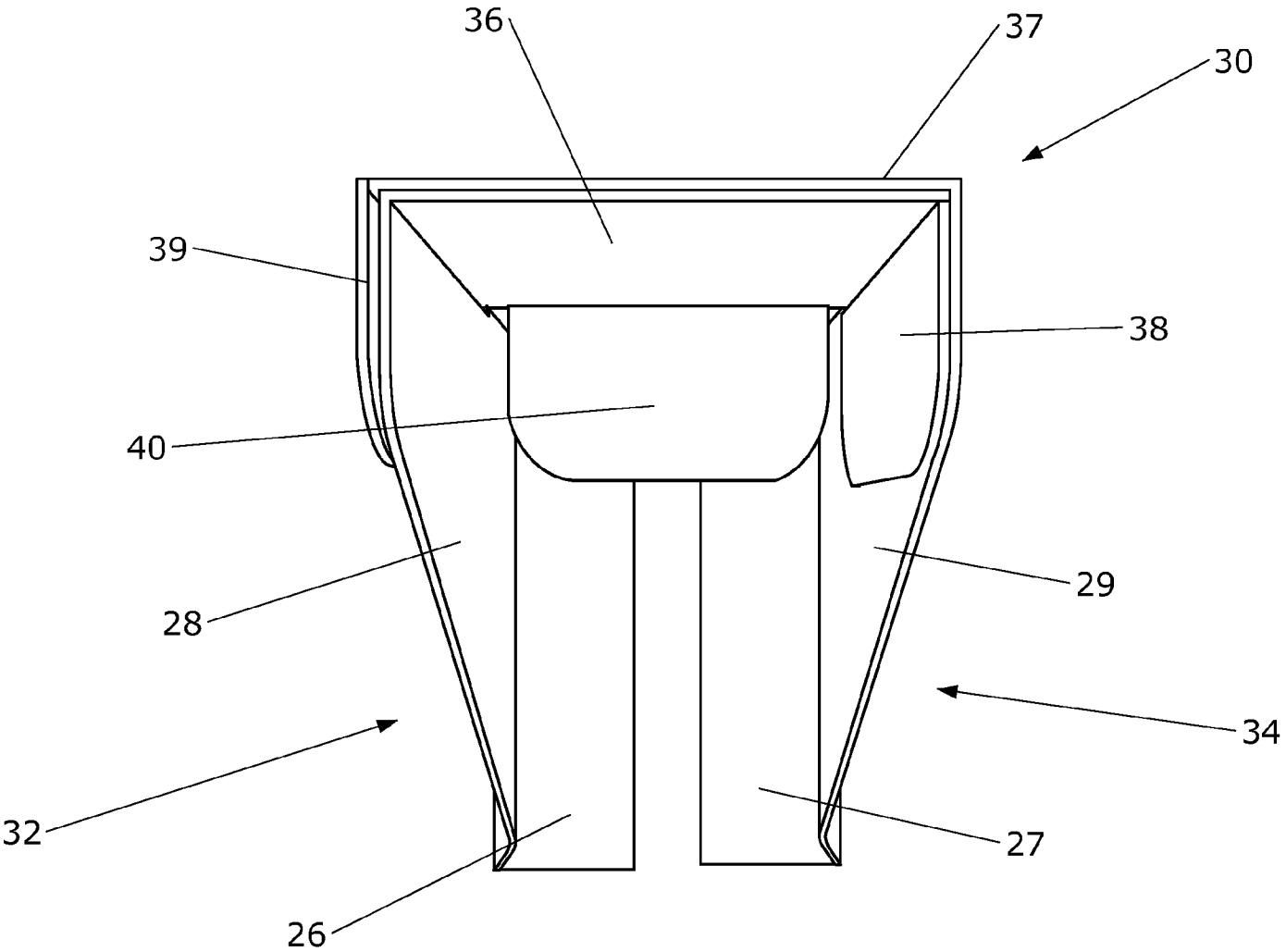
FIG. 8 is a perspective view, showing the brackets coupled together to form anchoring bracket.

FIG. 7 shows the manner in which first and second brackets 32, 34 interlock by sliding one bracket on top of the other. While second bracket 34 is illustrated sliding on top of first bracket 32, the alternative could be true. When brackets 32, 34 are in place, as shown in FIG. 8, anchoring bracket 30 has the following configuration: bracket top flange 37 fits on top of bracket top flange 36; bracket side flange 39 rests on top of bracket side flap 28; bracket back flange 41 (not shown) rests on top of bracket back flange 40; bracket side flap 29 rests on top of bracket side flange 38; and bracket blade 26 lies on the same plane as bracket blade 27. In a preferred embodiment first bracket 32 and second bracket 34 of the anchoring bracket 30 are held in place by gravity. In an alternative embodiment first bracket 32 and second bracket 34 could be held together by an adhesive or putty.

Figure 9:
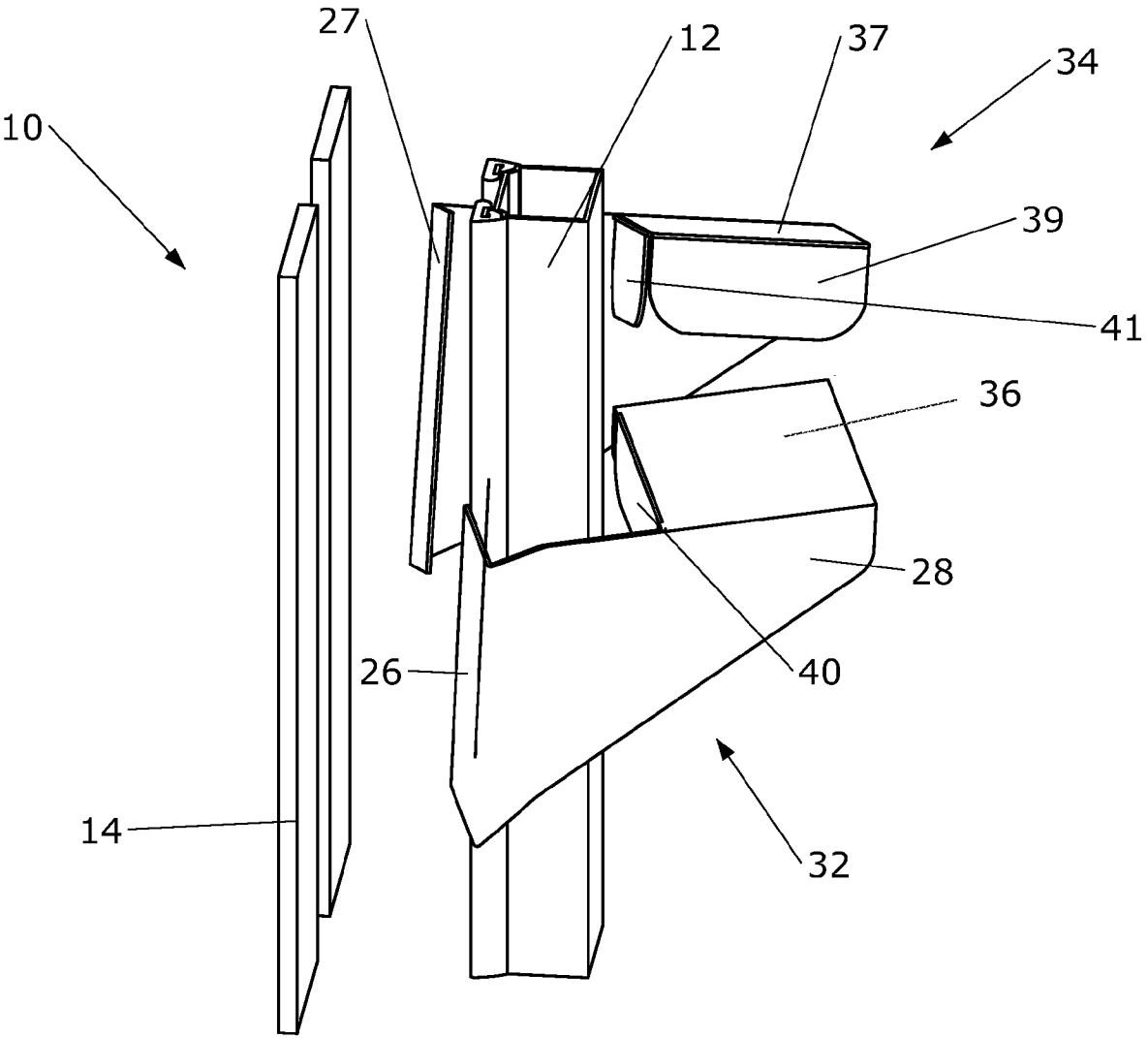
FIG. 9 is a perspective view, showing the brackets installation in a preferred embodiment of the invention.

A perspective view of the placement of first bracket blade 26 on first bracket 32 and second bracket blade 27 on second bracket 34 around extruded column 12 on wall construction 10 is shown in FIG. 9. Structural medium 14 is separated from extruded column 12 and gaskets 16 for clarity, to show the position of bracket blades 26, 27 between gaskets 16 and structural medium 14. The first bracket 32 is attached to extruded column 12 by sliding first bracket blade 26 between gasket 16 and structural medium 14. The second bracket 34 fits around extruded column 12 and second bracket blade 27 is inserted between gasket 16 and structural medium 14 on the opposing side of extruded column 12. Second bracket 34 is inserted either above or below first bracket 32. The reader will appreciate that when first and second brackets 32, 34 are mated together to form anchoring bracket 30 (as illustrated in FIG. 5) the pressure applied by gasket 16 which holds anchoring bracket 30 in place relative to the ground, received additional structural support from the back flange 40, 41 which is proximate to extruded column 12. When pressure is placed on top of anchoring bracket 30, the back flange will press against extruded column 12 opposing the downward pull. Anchoring bracket 30 is sized in such a way that the space defined by the intersection of bracket blade 26, bracket side flap 28, and the inner side of anchoring bracket 30 proximate to extruded column 12 snugly fits extruded column 12. Bracket blade 26 should be sized to tightly fit gasket 16, not being so large that it does not fit behind extruded column 12 but not so small that bracket blade 26 will not slide behind gasket 16.

Figure 10:
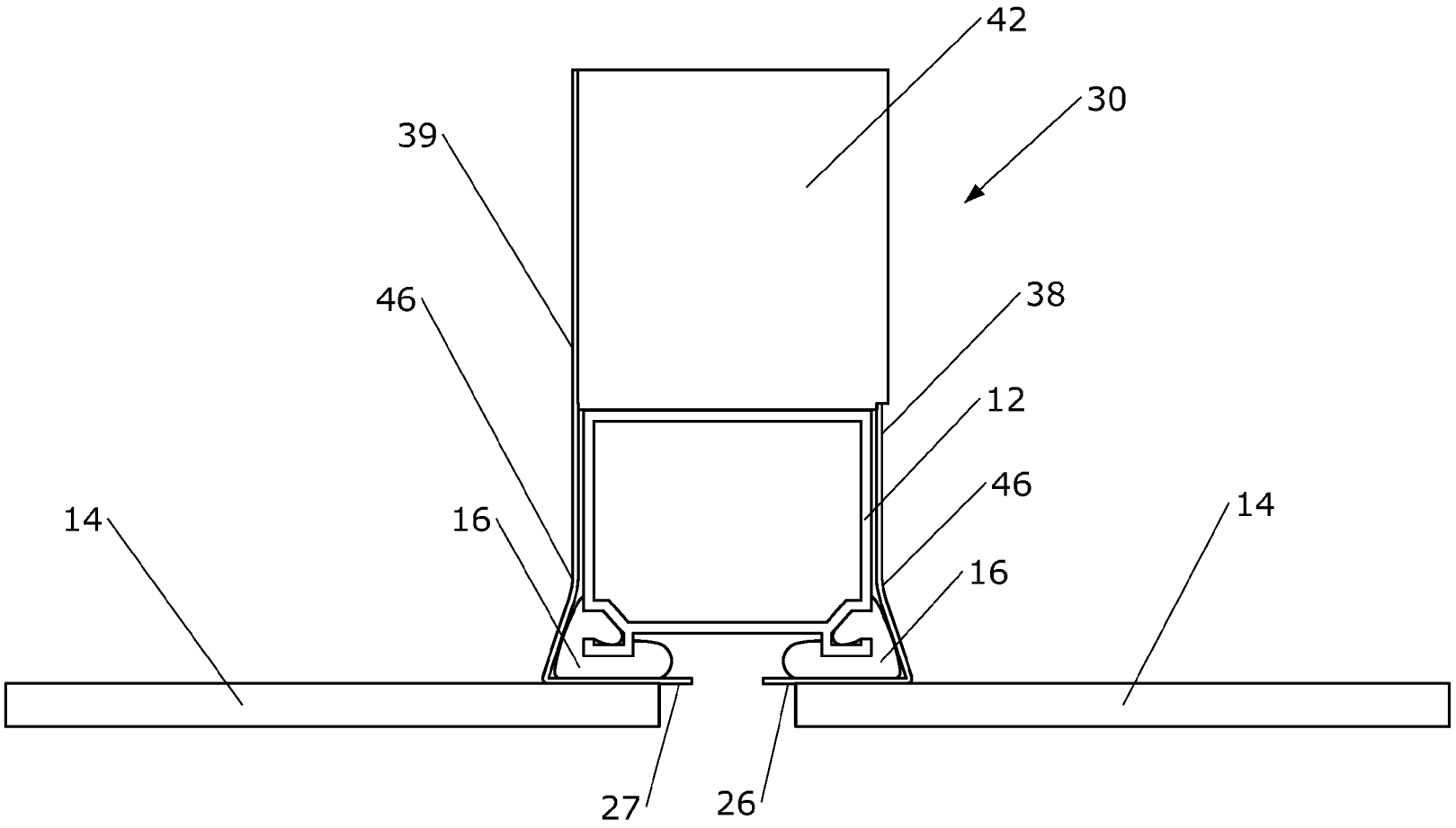
FIG. 10 is a top plan section view, showing brackets placement around extruded column.

FIG. 10 shows a top sectional plan view of anchoring bracket 30 as it fits against structural medium 14, which in a preferred embodiment is glass, and gasket 16. Extruded column 12 is shown proximate to gasket 16. Bracket blade bend 46 in a preferred embodiment is shaped in such a way that gasket 16 fits inside anchoring bracket 30. Bracket side flange 38, 39 is shown proximate to extruded column 12. As stated before, bracket blades 26, 27 are held in place by the pressure from gasket 16. Bracket blades 26, 27 are also held in place against gravity by frictional forces between bracket blades 26, 27, gasket 16, and structural medium 14, said forces may be increased based off the material chosen for bracket blades 26, 27. The preferred linking mechanism is the first and second brackets 32, 34 simply locking together. The linking together is seamless as illustrated in FIG. 9.

Figure 11:
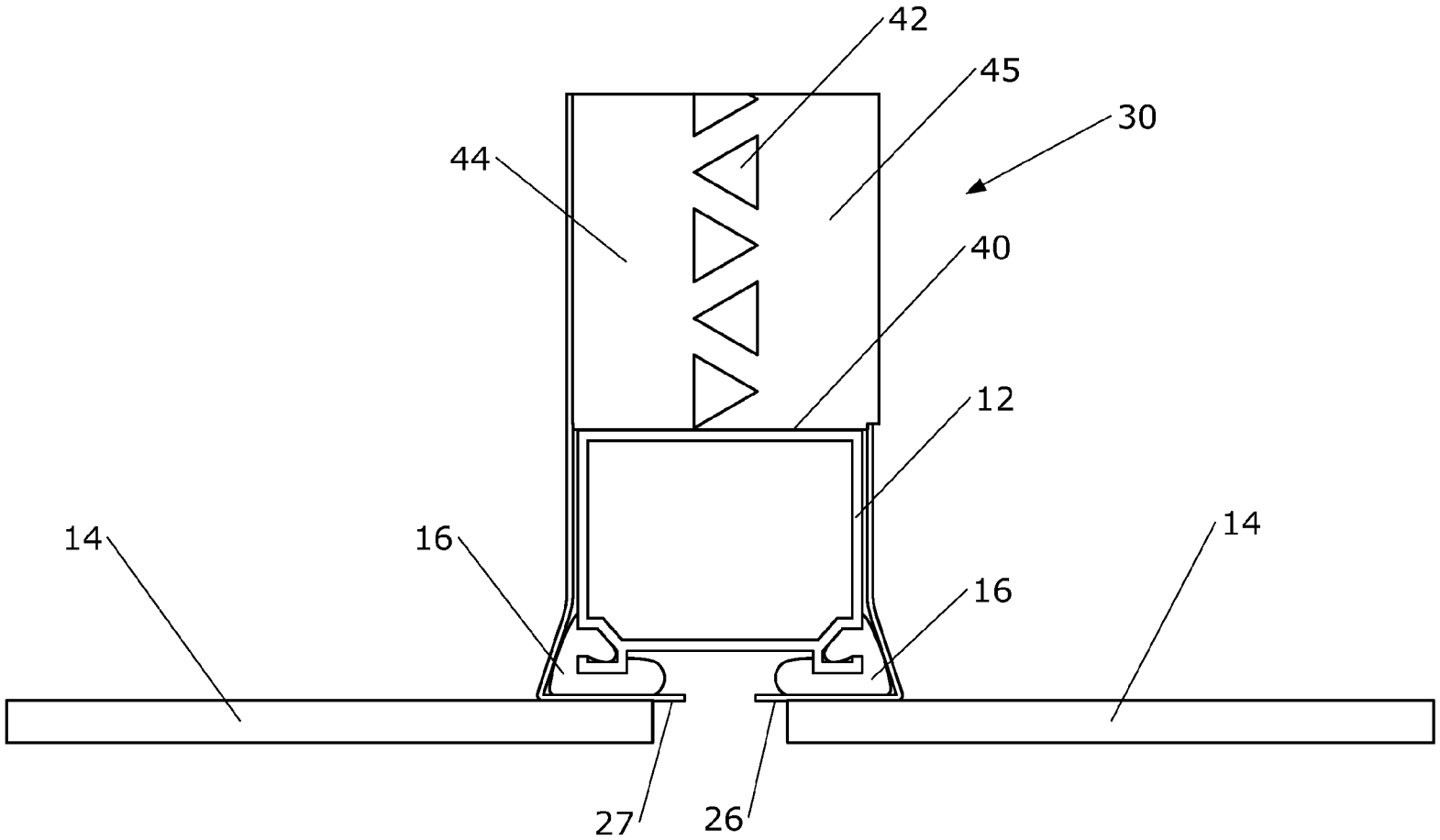
FIG. 11 is a top plan section view, showing brackets coupled together and installed on extruded column.

FIG. 11 displays a plan view showing an alternative linking mechanism 42 between the two pieces of the anchoring bracket. Anchoring bracket 30 is broken into two sections, bracket section 44 and bracket section 45. Bracket section 44 and bracket section 45 are held in place by linking mechanism 42. A variety of mechanically simple linking mechanisms are viable for linking mechanism 42, however linking mechanism 42 depicts an interlocking style. As in FIG. 9, bracket back flange 40 is shown proximate to extruded column 12. Bracket back flange 40 provides additional structural support for the anchoring bracket 30 by pressing against extruded column 12 when downward pressure is applied to the anchoring bracket 30. Gasket 16 is shown proximate to extruded column 12. Gasket 16 holds bracket blade 26, 27 in place against structural medium 14, which in a preferred embodiment is glass.

Figure 12:
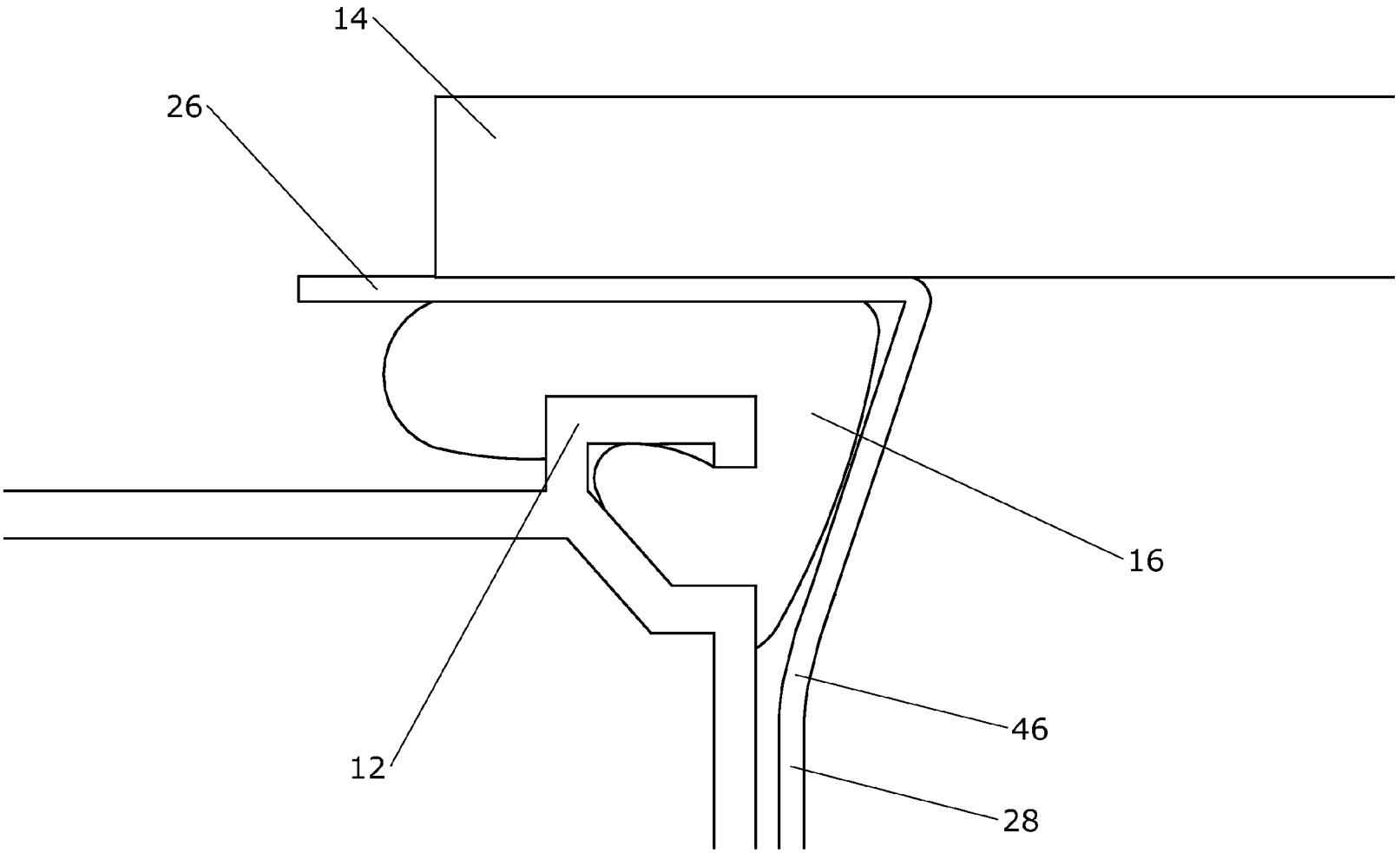
FIG. 12 is an exploded view, showing the bracket blade between gasket and structural medium.

FIG. 12 provides an exploded section view showing bracket blade 26 as it fits against structural medium 14 and gasket 16. FIG. 9 also displays bracket blade bend 46 which in a preferred embodiment is shaped in such a way that gasket 16 fits inside. Bracket side flap 28 is shown proximate to extruded column 12. As stated before, bracket blade 26 is held in place by the pressure from gasket 16. Bracket blade 26 is also held in place against gravity by frictional forces between bracket blade 26, gasket 16, and structural medium 14, said forces may be increased based off the material chosen for bracket blade 26.

We claim:

1. An anchoring system for mounting on a wall construction having a vertical extruded column, a first gasket, a second gasket, a first structural medium, and a second structural medium, wherein said anchoring system comprises:

a. a first bracket having:
   i. a blade, wherein said blade is configured to be inserted between said first gasket and said first structural medium;
   ii. a side flap extending from said blade;
   iii. a top flange extending from said side flap;
   iv. a void between said top flange and said blade;
   v. a bracket side flange extending directly downward from said top flange;
   vi. a bracket back flange extending directly downward from said top flange;
   vii. wherein said blade and said top flange lie in substantially perpendicular planes with respect to one another; and
   viii. wherein said bracket back flange is configured to contact said vertical extruded column;

b. a second bracket having:
   i. a blade, wherein said blade is configured to be inserted between said second gasket and said second structural medium;
   ii. a side flap extending from said blade;
   iii. a top flange extending from said side flap;
   iv. a void between said top flange and said blade;
   v. a bracket side flange extending directly downward from said top flange;
   vi. a bracket back flange extending directly downward from said top flange;
   vii. wherein said blade and said top flange lie in substantially perpendicular planes with respect to one another; and
   viii. wherein said bracket back flange is configured to contact said vertical extruded column;

c. wherein said blade of said first bracket and said blade of said second bracket are configured to be inserted on opposite sides of said vertical extruded column such that said first bracket and said second bracket are connected together such that said top flange of said second bracket fits over said top flange of said first bracket to form an anchoring bracket.

2. The anchoring system of claim 1, wherein said anchoring bracket is coupled to an external structure.

3. The anchoring system of claim 2, wherein said external structure is a shelf, wherein said anchoring bracket is a first anchoring bracket, wherein said anchoring system further comprises a second anchoring bracket identical to said first anchoring bracket, and wherein said shelf is attached to said first anchoring bracket and said second anchoring bracket.

4. The anchoring system of claim 1, wherein said first and second brackets are interlocked.

5. The anchoring system of claim 1, wherein said anchoring bracket further includes a bracket blade bend on said side flap of said first bracket and a bracket blade bend on said side flap of said second bracket.

6. The anchoring system of claim 1, wherein said blade of said first bracket and said blade of said second bracket are metal.

7. An anchoring system for a wall construction having an extruded column, a first gasket, a second gasket, a first structural medium, and a second structural medium, wherein said anchoring system comprises:

a. an anchoring bracket including:
   i. a first bracket having a bracket blade, a bracket side flap, a bracket top flange, a bracket side flange, a bracket back flange, and a void, wherein said void is between said bracket blade and said bracket top flange, wherein said bracket side flange extends directly downward from said bracket top flange, and wherein said bracket back flange extends directly downward from said bracket top flange;
   ii. a second bracket having a bracket blade, a bracket side flap, a bracket top flange, a bracket side flange, a bracket back flange, and a void, wherein said void is between said bracket blade and said bracket top flange, wherein said bracket side flange extends directly downward from said bracket too flange, and wherein said bracket back flange extends directly downward from said bracket too flange;
   iii. wherein said bracket blades are substantially vertically oriented;
   iv. wherein said bracket top flanges are substantially horizontally oriented; and
   v. wherein said first bracket and said second bracket are linked together by fitting said bracket top flange of said second bracket over said bracket top flange of said first bracket;

b. wherein said bracket blade of said first bracket is capable of frictionally engaging with said first gasket on a first side of said extruded column;

c. wherein said bracket blade of said second bracket is capable of frictionally engaging with said second gasket on a second side of said extruded column opposite said first side;

d. wherein said bracket back flange of said first bracket is capable of contacting said extruded column; and e. wherein said bracket back flange of said second bracket is capable of contacting said extruded column.

8. The anchoring system of claim 7, wherein said anchoring bracket is a first anchoring bracket, wherein said anchoring system further comprises a second anchoring bracket identical to said first anchoring bracket, and wherein an external structure is coupled to said first anchoring bracket and said second anchoring bracket.

9. The anchoring system of claim 7, wherein said bracket back flange of said first bracket and said bracket back flange of said second bracket provide additional support to said anchoring bracket.

10. The anchoring system of claim 7, wherein said first and second brackets are interlocked.

11. The anchoring system of claim 7, wherein said anchoring bracket further includes a bracket blade bend on said bracket side flap of said first bracket and a bracket blade bend on said bracket side flap of said second bracket.

12. The anchoring system of claim 7, wherein said bracket blade of said first bracket and said bracket blade of said second bracket are metal.

13. The anchoring system of claim 7, wherein an external structure is coupled to said bracket top flange of said first bracket and said bracket top flange of said second bracket.

14. The anchoring system of claim 7, wherein said bracket top flange of said first bracket and said bracket top flange of said second bracket are configured to be arranged in a downward facing position.

* * * * *